US005358830A

United States Patent [19]

Twist

[11] Patent Number: 5,358,830

[45] Date of Patent: Oct. 25, 1994

[54] METHOD OF PHOTOGRAPHIC PROCESSING

[75] Inventor: Peter J. Twist, Bucks, United Kingdom

[73] Assignee: Eastman Kodak Company, Rochester, N.Y.

[21] Appl. No.: 162,449

[22] Filed: Dec. 3, 1993

[30] Foreign Application Priority Data

Dec. 4, 1992 [GB] United Kingdom ..... 9225353

[51] Int. Cl.[5] ..... G03C 5/18; G03C 5/26; G03C 7/00; G03C 3/00

[52] U.S. Cl. ..... 430/399; 430/373; 430/398; 430/414; 430/421; 430/427; 430/943; 430/17

[58] Field of Search ..... 430/373, 398, 399, 414, 430/421, 427, 936, 943

[56] References Cited

U.S. PATENT DOCUMENTS

| | | | |
|---|---|---|---|
| 4,128,424 | 12/1978 | Geyken et al. | 430/427 |
| 4,606,827 | 8/1986 | Ernstson et al. | 430/399 |
| 4,983,504 | 1/1991 | Marsden et al. | 430/399 |
| 5,260,184 | 11/1993 | Marsden et al. | 430/399 |

FOREIGN PATENT DOCUMENTS

| | | | |
|---|---|---|---|
| 2527398 | 1/1976 | Fed. Rep. of Germany | 430/373 |
| WO-A-90 | | | |
| 13061 | 11/1990 | PCT Int'l Appl. . | |
| WO-A-91 | | | |
| 16666 | 10/1991 | PCT Int'l Appl. . | |
| 9112567 | 8/1991 | World Int. Prop. O. . | |
| 9301524 | 1/1993 | World Int. Prop. O. . | |

*Primary Examiner*—Charles L. Bowers, Jr.
*Assistant Examiner*—J. Pasterczyk
*Attorney, Agent, or Firm*—Sarah Meeks Roberts

[57] ABSTRACT

A method of color processing in which an imagewise exposed color photographic silver halide material is processed by a procedure which comprises treating it with a color developer solution and then with a developer/amplifier solution containing a color developing agent and hydrogen peroxide in which said solutions are replenished so that the overflow from the developer/amplifier solution is treated to remove hydrogen peroxide and used to form the sole replenisher for the color developer solution while the overflow from said color developer solution is disposed of as the net overflow of the two processing solutions.

14 Claims, 3 Drawing Sheets

METHOD OF PHOTOGRAPHIC PROCESSING

FIELD OF THE INVENTION

The invention relates to a method of photographic processing and, in particular, to a method of processing comprising the redox amplification method of colour image formation.

BACKGROUND OF THE INVENTION

Redox amplification processes have been described, for example in British Specification Nos. 268,126, 1,399,481, 1,403,418 and 1,560,572. In such processes colour materials are either developed to produce a silver image (which may contain only small amounts of silver) and then treated with a redox amplifying solution (so-called "split development") or treated with a combined developer-amplifier (dev/amp) to form a dye image. The developer-amplifier solution contains a reducing agent, for example a colour developing agent, and an oxidising agent which will oxidise the colour developing agent in the presence of the silver image which acts as a catalyst. The photographic material used in such a process may be a conventional coupler-containing silver halide material or an image transfer material containing redox dye releasers. Oxidised colour developer reacts with a colour coupler (usually contained in the photographic material) to form image dye. The amount of dye formed depends on the time of treatment or the availability of colour coupler rather than the amount of silver in the image as is the case in conventional colour development processes. Examples of suitable oxidising agents include peroxy compounds including hydrogen peroxide and compounds which provide hydrogen peroxide, e.g. addition compounds of hydrogen peroxide; cobalt (III) complexes including cobalt hexammine complexes; and periodares. Mixtures of such compounds can also be used. A particular application of this technology is in the processing of silver chloride colour paper, especially such paper with low silver levels.

Solutions which contain both a colour developing agent and an oxidising agent are inherently unstable as these two components react with each other. A number of solutions of this problem have been proposed. One such approach is to use the processing chemicals once only. This is both expensive and produces a considerable amount of effluent that needs to be safely disposed of. Keeping the developer and the amplifier as separate solutions or using a developer and then a developer/amplifier is another approach. Another method is described in our PCT specification (EP 90/00726) wherein peroxide is removed after a developer/amplifier has been used so that it does not deteriorate on standing. Before use the correct amount of peroxide is added again.

When using redox amplification in a commercial environment, e.g. in a minilab processing machine, replenishment is normally carried out to keep the processing solutions operating within acceptable limits. Such a system which employs fast recirculation of processing solutions can also provide replenishment as described in our PCT Application EP91/00266 publication no. WO91/12567.

Our PCT Application EP92/01526 describes a develop followed by develop/amplify redox amplification process in which the developer is replenished and the overflow from the developer provides the sole replenisher for the dev/amp solution.

PROBLEM TO BE SOLVED BY THE INVENTION

The object of the present invention is to provide a replenishment system in which developer/amplifier solutions have higher stability, higher activity and lower replenishment rates.

SUMMARY OF THE INVENTION

According to the present invention there is provided a method of colour processing in which an imagewise exposed colour photographic silver halide material is processed by a procedure which comprises treating it with a colour developer solution and then with a developer/amplifier solution containing a colour developing agent and hydrogen peroxide or a compound which provides hydrogen peroxide and in which said solutions are replenished characterised in that the overflow from the developer/amplifier solution is treated to remove hydrogen peroxide and used to form the sole replenisher for the colour developer solution while the overflow from said colour developer solution is disposed of as the net overflow of the two processing solutions.

ADVANTAGEOUS EFFECT OF THE INVENTION

Figure 1:
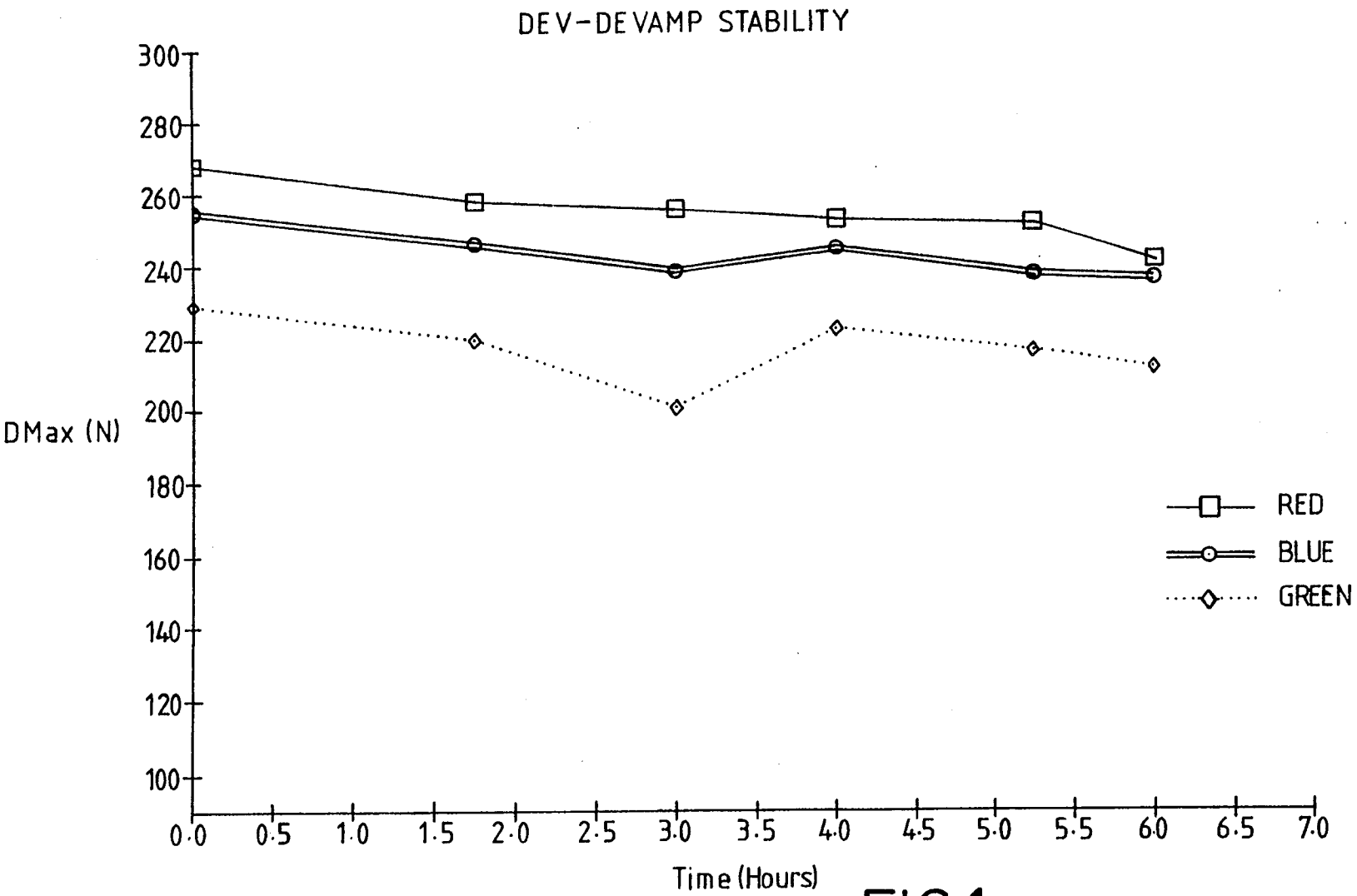
FIGS. 1 to 3 of the accompanying drawings are plots of $D_{max}$ versus time in hours and represent solution stability of the solutions described in the Examples below.

The advantages of the present invention are as follows:

1. The net waste in terms of colour developing agent from this system can be less than for other methods of split-development and less than that for a single developer-amplifier solution. This is because the first developer can be lower in colour developing agent level than in other versions of split-development or in single developer-amplifier systems.

2. For the same colour paper the chloride ion content of the developer-amplifier in this system can be lower than that for other methods of split-development and lower than that for a single developer-amplifier solution. This allows for a higher activity with a given level of active components than in other systems.

3. Because the chloride ion level can be low in this system the concentration of active components such as colour developing agent and hydrogen peroxide, and temperature can be low such that the standing stability of the present system is better than other split-development and single developer-amplifier systems designed to process the same type of low silver colour paper.

DETAILED DESCRIPTION OF THE INVENTION

The two image forming steps are optionally followed by bleach and/or fix and/or wash and/or stabilise processing steps.

A number of ways of removing hydrogen peroxide from amplifier solutions will now be described.

(1) Electrolytic reduction at a cathode:

$$2H^+ + 2e^- + H_2O_2 \rightarrow 2\ H_2O$$

with or without the addition of extra sulphite for added protection. One advantage is that non-oxidised developer is unaffected and oxidised developer may even be reduced back to its non-oxidised form at the cathode. The type of cathode may be very important and an acceptable anodic reaction would have to be chosen or the anode would have to be separated via a semi-permeable or anionic membrane. Migration of the $HO_2^-$ ion from the cathode would also help. Preferred electrode materials are titanium, platinum, platinum-rhodium, platinum coated titanium and silver. The electrodes may be rough or smooth and may be coated with manganese dioxide. This process is preferably carried out in an electrolytic cell with or without a semipermeable membrane before returning the solution for reuse.

(2) Certain compounds (scavengers) may be preferentially oxidised (rather than colour developer) by $H_2O_2$ and so could be used sacrificially to remove the peroxide. A redox indicator dye may serve to show when enough reducing compound has been added. Examples of such compounds are hydroquinones, ballasted hydroquinones, hydrazines, aldehydes and compounds capable of tautomerising to give an enediol form, for example, ascorbic acid, reductone, methyl reductinic acid, dihydroxy acetone, 2,4-dihydroxy-4- methyl-1-piperidinocyclopenten-3-one (piperidino hexose reductone), catechol, ascorbyl palmitate and chromanols. Inorganic scavengers may be dithionites or phosphites. A particularly useful class of inorganic scavengers comprises water soluble or water insoluble sulphites and metabisulphites, e.g. sodium metabisulphite. Such scavengers may be added as solids or solutions and have the advantages of speed, inexpensiveness and do not cause loss of colour developing agent. Such treatment may be carried out in a separate vessel. Alternatively the scavenger could be coated in a layer of the photographic material being processed, e.g. as a top layer on the back of the material. Such a material would deposit scavenger directly into the dev/amp solution and a timing layer coated over the scavenger layer could be used to delay release.

(3) Mordanted oxidisable dye. If this were in a cartridge with a window some indication of the state of the cartridge could be obtained and so it could be replaced when necessary. The solution to be treated would be passed, e.g. by pumping, through the cartridge.

(4) Catalytic decomposition and oxygen removal. Catalysts are numerous, the main criterion being small particle size, for example Mn, Ni, Pt, Ag, Pd Glass, Fe, manganous salts, manganous hydroxide, $MnO_2$, compounds which provide manganous hydroxide or $MnO_2$, catalase, black magnetic iron oxide ($Fe_3O_4$), ferrous salts, black copper oxide and cuptic salts. It would be most advantageous if the catalytic surface could aid in "fixing" the oxygen e.g. $SO_3^= + 0 \rightarrow SO_4^=$; sulphite being supplied from solution. Alternatively metal $+0 \rightarrow$ metal oxide. The catalytic activity may be regenerated electrolytically by cathodic reduction. The preferred methods use manganese dioxide, catalase, palladium black, Adams platinum oxide catalyst, ground pumice and cathodic electrolysis. The treatment with the catalyst should take place ira a separate vessel. Alternatively the catalyst could be coated in a layer of the photographic material being processed, e.g. as a top layer on the back of the material as in (4) above.

(5) Combined oxygen permeable membrane and catalyst. Decompose the peroxide at the membrane surface and allow oxygen to diffuse into an air space (c.f. removal of $NH_3$ from developers with yeast bags). This treatment should take place in a separate vessel.

(6) Vacuum should favour decomposition because of the formation of a gas i.e. by subjecting a thin film of the solution to a vacuum it may be possible to pull off the oxygen from a catalytic surface (as for method (2) above). A separate vessel should be used that can be evacuated when a batch is ready to be treated.

(7) Decomposition of hydrogen peroxide in the presence of a catalyst (as in method (4) above) is accelerated by ultrasonic agitation. Cavitation may favour such decomposition.

(8) Dialysis, through semipermeable membranes, of the used solution to remove the hydrogen peroxide using a closed loop for the extraction solution. The process should be arranged so that the maximum concentration difference in hydrogen peroxide will exist across the membrane and depends on the non-passage (or reduced passage) of reducing agent through the membrane. Any chloride ion released in the amplification process would also be extracted and this could be an added advantage. Again a separate vessel is preferably used for this process.

(9) The used amplification solution is boiled under reduced pressure in a separate vessel. The vapour in equilibrium with the solution will be a mixture of $H_2O$ and $H_2O_2$. If this vapour is drawn off and passed over a catalyst the hydrogen peroxide may then be decomposed to oxygen and water. The water could be condensed and returned to the main solution and the oxygen would be exhausted and discarded via the vacuum pump.

Of the above methods the preferred method is to add a sulphite (as scavenger) to remove any hydrogen peroxide remaining in the overflow.

Preferred colour developing agents are p-phenylene diamines. Especially preferred are 4-amino- 3-methyl-N,N-diethylaniline hydrochloride, 4-amino-3-methyl-N-ethyl-N-b-(methanesulphonamido)-ethylaniline sulphate hydrate, 4-amino-3-methyl-N-ethyl-N-b-hydroxyethylaniline sulphate, 4-amino-3-b-(methanesulphonamido)ethyl-N,N-diethylaniline hydrochloride and 4-amino-N-ethyl-N-(2-methoxy-ethyl)-m-toluidinedi-p-toluene sulphonate. Of these, the preferred colour developing agent for use in the present invention is Diethylhydroxylamine-4-N-ethyl-N-(β-methane-sulphonamidoethyl)-o-toluidine sesquisulphate (CD3).

Examples of suitable oxidising agents include peroxy compounds including hydrogen peroxide and compounds which provide hydrogen peroxide, e.g. addition compounds of hydrogen peroxide. Mixtures of such compounds can also be used. Preferably the oxidant is hydrogen peroxide.

The preferred level of colour developing agent in the developer solution is from 0.2–10, preferably from 1–3 g/1. The preferred level of colour developing agent in the developer/amplifier is from 0.5–15, preferably from 1–4 g/1.

The preferred level of hydrogen peroxide in the developer/amplifier is from 0.1–30, preferably from 1–5 ml/1 (as 30% solution).

The developer/amplifier is preferably replenished from separate colour developing agent solution and oxidant, e.g. hydrogen peroxide, solutions. The amounts used and the concentration of their solutions are adjusted so that the desired amount of overflow is generated and their levels in both the processing solutions are maintained at a steady state. The volume of replenisher may be such that it achieves zero overflow in the developer upwards.

Typically the rate of replenishment of colour developing agent in the dev/amp will be from 300–1200 mg/m$^2$ of photographic material processed. The rate of oxidant addition is such that the developer/amplifier (which is initially completely free of oxidant) attains the desired level set out above.

Both solutions will preferably have a pH in the range 10–12, more preferably 10–10.5, and this is conveniently achieved using potassium carbonate.

The colour photographic material to be processed may be of any type but will preferably contain low amounts of silver halide. Preferred silver halide coverages are in the range 1 to 270, preferably 10 to 150 mg/m$^2$ (as silver). The material may comprise the emulsions, sensitisers, couplers, supports, layers, additives, etc. described in Research Disclosure, December 1978, Item 17643, published by Kenneth Mason Publications Ltd, Dudley Annex, 12a North Street, Erosworth, Hants P010 7DO, U.K. which is incorporated herein by reference.

In a preferred embodiment the photographic material comprises a resin-coated paper support and the emulsion layers comprise more than 80%, preferably more than 90% silver chloride and are more preferably composed of substantially pure silver chloride. Such materials will often have potassium chloride added to the emulsions after their formation to improve raw stock keeping properties (shelf life).

The photographic materials can be single colour materials or multicolour materials. Multicolour materials contain dye image-forming units sensitive to each of the three primary regions of the spectrum. Each unit can be comprised of a single emulsion layer or of multiple emulsion layers sensitive to a given region of the spectrum. The layers of the materials, including the layers of the image-forming units, can be arranged in various orders as known in the art.

A typical multicolour photographic material comprises a support bearing a yellow dye image-forming unit comprised of at least one blue-sensitive silver halide emulsion layer having associated therewith at least one yellow dye-forming coupler, and magenta and cyan dye image-forming units comprising at least one green- or red-sensitive silver halide emulsion layer having associated therewith at least one magenta or cyan dye-forming coupler respectively. The material can contain additional layers, such as filter layers.

The elements of the invention can include additional couplers as described in Research Disclosure Section VII, paragraphs F, G, and H and the publications cited therein. The couplers of this invention and any additional couplers can be incorporated in the elements and emulsions as described in Research Disclosures of Section VII, paragraph C and the publications cited therein.

The photographic elements of this invention or individual layers thereof, can contain brighteners (see Research Disclosure Section V), antifoggants and stabilisers (see Research Disclosure Section VI), antistain agents and image dye stabiliser (see Research Disclosure Section VII, paragraphs I and J), light absorbing and scattering materials (see Research Disclosure Section VIII), hardeners (see Research Disclosure Section X), plasticisers and lubricants (see Research Disclosure Section XII), antistatic agents (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a colour developing agent to reduce developable silver halide and oxidise the colour developing agent. Oxidised colour developing agent in turn reacts with the coupler to yield a dye.

With negative-working silver halide emulsions this processing step leads to a negative image. To obtain a positive (or reversal) image, this step can be preceded by development with a non-chromogenic developing agent to develop exposed silver halide, but not form dye, and then uniform fogging of the element to render unexposed silver halide developable. Alternatively, a direct positive emulsion can be employed to obtain a positive image.

The developer and developer/amplifier solutions may contain components well known in the art, for example colour developing agents, alkaline agents, sequestering agents, preservatives, antioxidants or halide ions. The preferred oxidant for the developer/amplifier solutions is hydrogen peroxide.

Figure 2:
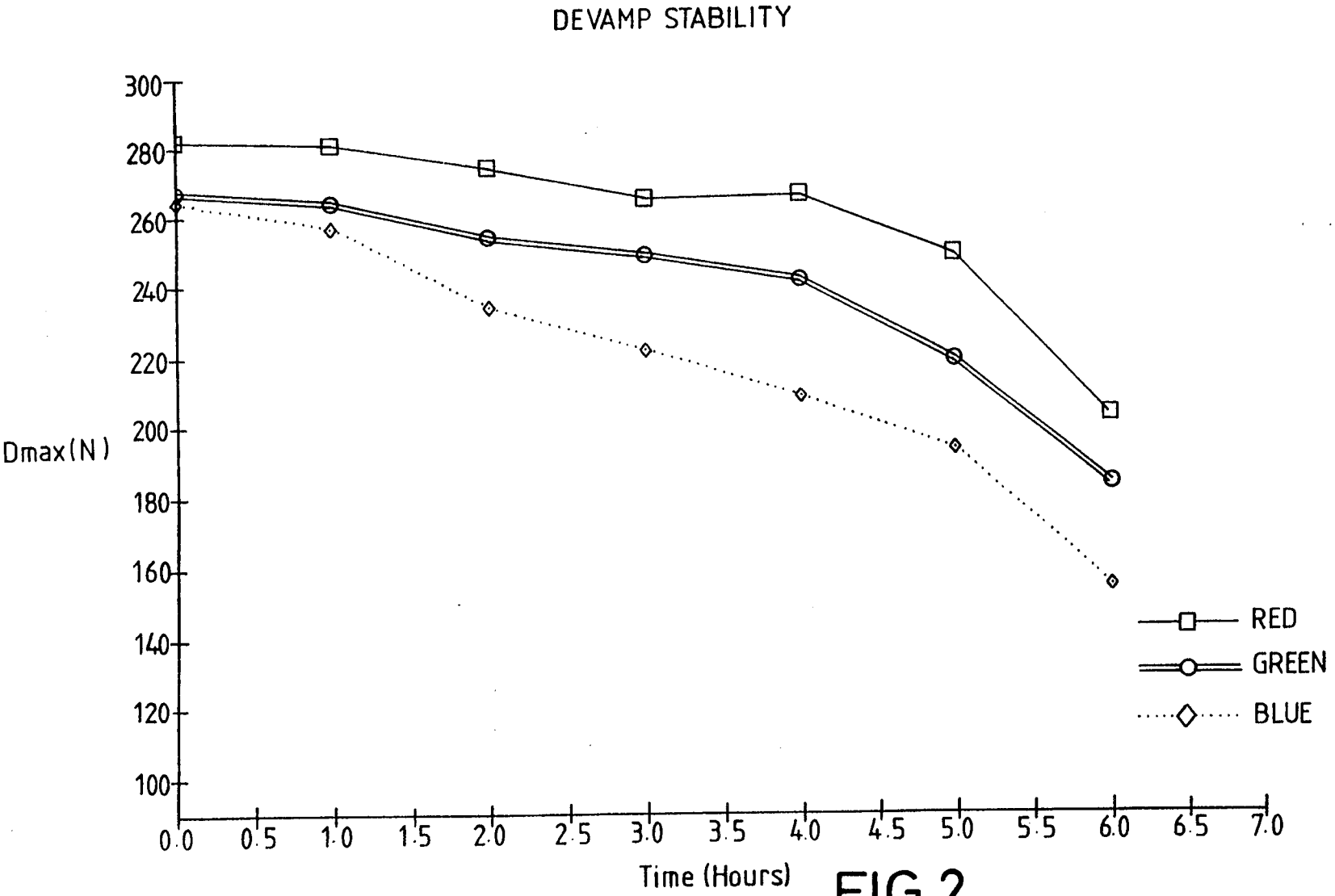
Figure 3:
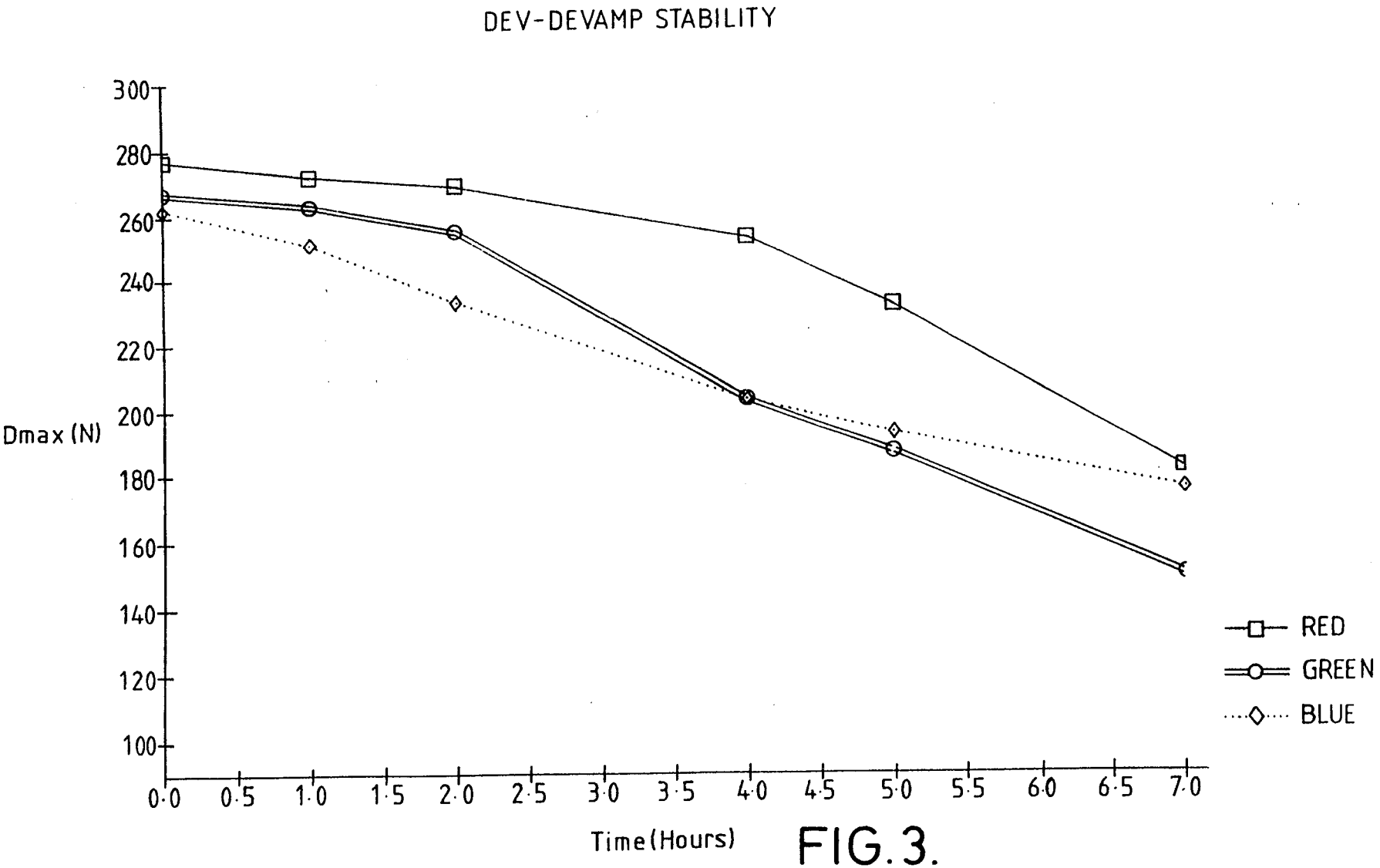

FIGS. 1–3 of the accompanying drawings are plots of red, green and blue $D_{max}$ versus time which indicate deterioration of the processing solution over time. They represent the experimental results described below.

The following Examples are included for a better understanding of the invention. The photographic material processed in the following Examples is a photographic silver chloride colour paper having a total coating weight of 122 mg/m$^2$ (as silver) and containing additional potassium chloride such that it seasons out 63 mg of KCl per square meter of material processed.

EXAMPLE 1

The formulation for the developer and developer-amplifier are shown in Table 1 below.

TABLE 1

Improved Split Development System

| Component | Dev | Dev/amp |
|---|---|---|
| 1-hydroxyethylidene-1,1'-diphosphonic acid (60% aq. soln.) | 1.2 g/l | 1.2 g/l |
| diethyltriamine-penta-acetic acid (40% aq. soln.) | 2.0 ml/l | 2.0 ml/l |
| Potassium carbonate | 25.0 g/l | 25.0 g/l |
| Potassium chloride | 0.8 g/l | 0.2 g/l |
| Potassium bromide | 1.0 mg/l | 0.25 mg/l |
| Diethylhydroxylamine | 4.0 ml/l | 4.0 ml/l |
| 4-N-ethyl-N-(β-methane-sulphon-amidoethyl)-o-toluidine sesquisulphate (CD3) | 1.5 g/l | 2.0 g/l |
| Hydrogen peroxide (30% solution) | — | 3.0 ml/l |
| pH | 10.0 | 10.3 |
| Temperature | 32° C. | 32° C. |
| Time | 20 sec | 40 seconds |

The developer-amplifier is replenished with a developer-replenisher and a peroxide replenisher of the composition shown in Table 2 below.

TABLE 2

| Replenisher for Developer-Amplifier | | |
|---|---|---|
| Component | Dev Rep. | Peroxide Rep. |
| 1-hydroxyethylidene-1,1'-diphosphonic acid (60% aq. soln.) | 1.31 g/l | |
| diethyltriamine-penta-acetic acid (40% aq. soln.) | 2.2 ml/l | |
| Potassium carbonate | 27.3 g/l | |
| Diethylhydroxylamine | 4.4 l/l | |
| 4-N-ethyl-N-(β-methanesulphon-amidoethyl)-o-toluidine sesquisulphate (CD3) | 6.0 g/l | |
| | | 60 ml/l |
| pH | 10.7 | |

The developer-replenisher was used at 91.5 ml/m$^2$ and the peroxide-replenisher at 10.8 ml/m$^2$ of processed paper (13 cm wide).

Solid sodium sulphite is added to the overflow from the developer-amplifier solution and the resulting solution is used to replenish the first developer. This system gives good sensitometry with paper that seasons out a high chloride level of 63.2 mg/m$^2$ of potassium chloride during development. The total colour developing agent effluent from this system during the running phase is $$1.5\times69.5+2\times32.1=168.4\ mg/m^2.$$

The standing stability of this system in terms of neutral dye reflection densities versus solution age is shown in FIG. 1. It can be seen that this is superior to the comparison Examples in FIGS. 2 and 3.

EXAMPLE 2 (COMPARATIVE)

In order to obtain the same sensitometry with this paper in a single developer-amplifier solution as obtained in Example 1 a formula as shown in Table 3 is needed.

TABLE 3

| Single Developer-Amplifier | |
|---|---|
| Component | Dev/Amp |
| 1-hydroxyethylidene-1,1'-diphosphonic acid (60% Soln.) | 1.2 g/l |
| diethyltriamine-pentaacetic acid (40% Soln.) | 2.5 ml/l |
| Potassium carbonate | 25.0 g/l |
| Potassium chloride | 0.5 g/l |
| Potassium bromide | 1.0 mg/l |
| Diethylhydroxylamine | 4.0 ml/l |
| 4-N-ethyl-N-(β-methanesulphonamidoethyl) -o-toluidine sesquisulphate (CD3) | 3.5 g/l |
| Hydrogen peroxide (30%) | 5.0 ml/l |
| pH | 10.3 |
| Temp | 32° C. |
| Time | 45 secs |

This is replenished at 147.7 ml/m$^2$ of developer-amplifier with 12.8ml/m$^2$ of 2.5% hydrogen peroxide. The total CD3 effluent during the running phase is $$15\times37.45=562.5\ mg/m^2\ of\ CD^3.$$

This is significantly greater than that for Example 1 in this invention (168.4 mg/m$^2$ of CD3).

The standing stability of this example is shown in FIG. 2. This is less stable than that of Example 1 (FIG. 1) and about the same as that of Example 3 (FIG. 3).

EXAMPLE 3 (COMPARATIVE)

This earlier example of split-development has a two stage development system similar to that in Example 1 in that it comprises an initial developer stage followed by a developer-amplifier stage. Here the developer stage is replenished with a developer-replenisher and the overflow from this is used to replenish the developer-amplifier. The developer-amplifier is also replenished with a solution of hydrogen peroxide. The composition of the solutions is shown in Table 4.

TABLE 4

| Split-Development System | | |
|---|---|---|
| Component | Dev | Dev/Amp |
| 1-Hydroxyethylidene-1,1'-diphosphonic acid (60% Soln.) | 1.2 g/l | 1.1 g/l |
| Diethyltriamine-penta-acetic acid (40% aq. soln.) | 2.5 ml/l | 2.29 ml/l |
| Potassium carbonate | 25.0 g/l | 22.9 g/l |
| Potassium chloride | 0.65 g/l | 0.6 g/l |
| Potassium bromide | 1.2 mg/l | 1.1 mg/l |
| Diethylhydroxylamine | 4.0 ml/l | 3.67 ml/l |
| 4-N-ethyl-N-(β-methanesulphon-amidoethyl)-o-toluidine sesquisulphate (CD3) | 5.0 g/l | 2.0 g/l |
| Hydrogen peroxide (30% solution) | — | 7.0 ml/l |
| pH | 10.7 | 10.3 |
| Temp | 35° C. | 35° C. |
| Time | 20 seconds | 20 seconds |

The developer is replenished at 117.7 ml/m$^2$ and the developer-amplifier at 10.7 ml/m$^2$. The whole of the developer overflow and carry-out is fed into the developer-amplifier which amounts to about 117.7 ml/m$^2$ (minus a small amount for evaporation). The net overflow is entirely from the developer-amplifier and amounts to $128.4\times2=2.56.8$ mg/m$^2$ of CD3. This is less than the amount from the single developer-amplifier system (561.7 mg/ m$^2$ of CD3) but more than that from the new split-development system of this invention (15.75 mg/m$^2$ of CD3).

Although the system in Example 3 is superior to that in Example 2 in terms of CD3 waste it is about the same in terms of standing stability. An earlier version of the system in Example 3 designed to process a low silver paper that seasoned-out less chloride ion than the one used in Examples 1 to 3 had a lower chloride ion level in the developer-amplifier. This allowed adequate activity at a lower hydrogen peroxide level and a lower temperature and consequently was more stable than that in Example 3 and that in Example 2. A low silver paper with a higher chloride level could not however be developed satisfactorily in this formula as its activity was too low. It therefore had to be changed to that in Example 3 with the consequent loss in standing stability due to the increased peroxide concentration and temperature. The present invention, in Example 1, can process a low silver paper which seasons out a high chloride ion level and still have superior standing stability and lower CD3 waste than the comparison examples.

A comparison of the stability of the three systems of Examples 1 to 3 is shown in FIGS. 1 to 3 respectively. These show the maximum density as a function of the age of the solutions after adding the hydrogen peroxide to the developer-amplifier in each example. It can be seen that Example 1 has the best stability of all in that the maximum density remains higher for longer and falls at a lower rate than for the other two systems.

I claim:

1. A method of processing an imagewise exposed color photographic silver halide material, comprising:

treating said color photographic material in a first processing bath containing a color developer solution comprising a color developing agent;

treating said color photographic material, after treatment in said first bath, in a second processing bath containing a developer/amplifier solution comprising hydrogen peroxide, or a compound which provides hydrogen peroxide, and a color developing agent;

replenishing said second bath with one or more replenisher solutions in sufficient volume to cause overflow of said developer/amplifier solution from said second bath;

forming developer replenisher solution by treating said overflow to remove hydrogen peroxide; and replenishing said first bath solely with said developer replenisher solution.

2. A method as claimed in claim 1, wherein the concentration of color developing agent in color developer solution is from 0.2 to 10 g/l.

3. A method as claimed in claim 2, wherein the concentration of color developing agent in said developer solution is from 1 to 3 g/l.

4. A method as claimed in claim 1, wherein the concentration of color developing agent in said developer/amplifier solution is from 0.5 to 15 g/l.

5. A method as claimed in claim 4, wherein the concentration of color developing agent in said developer/amplifier solution is from 1 to 4 g/l.

6. A method as claimed in claim 1, wherein said developer/amplifier solution is prepared from a 30% hydrogen peroxide solution and the concentration of said 30% hydrogen peroxide solution in said developer/amplifier solution is from 0.1 to 30 ml/l.

7. A method as claimed in claim 6, wherein the concentration of said 30% hydrogen peroxide solution in said developer/amplifier solution is from 1 to 5 ml/l.

8. A method as claimed in claim 1, wherein said replenishing of said second bath is carried out with separate color developing agent and hydrogen peroxide solutions.

9. A method as claimed in claim 1, wherein said replenishing of said second bath is carried out at a rate of replenishment of color developing agent in said developer/amplifier solution from 300 to 1200 mg/m$^2$ of photographic material processed.

10. A method as claimed in claim 1, wherein said photographic material comprises a silver halide emulsion which is more than 80% silver chloride.

11. A method as claimed in claim 1, wherein said color photographic material comprises silver halide in an amount of from 1 to 270 mg/m$^2$ as silver.

12. A method as claimed in claim 11, wherein said color photographic material comprises silver halide in an amount of from 10 to 150 mg/m$^2$ as silver.

13. A method as claimed in claim 1, wherein said color photographic material is a multi-color photographic material comprising a support bearing a yellow dye image-forming unit comprised of at least one blue-sensitive silver halide emulsion layer having associated therewith at least one yellow dye-forming coupler, and magenta and cyan dye image-forming units comprising at least one green- or red-sensitive silver halide emulsion layer having associated therewith at least one magenta or cyan dye-forming coupler respectively.

14. An image-bearing color photographic material obtained by the method of claim 1.

* * * * *